US011859147B2

(12) United States Patent
Chaudhari et al.

(10) Patent No.: US 11,859,147 B2
(45) Date of Patent: Jan. 2, 2024

(54) SINGLE STAGE PROCESS FOR PRODUCTION OF HYDROGEN ENRICHED GAS

(71) Applicant: INDIAN OIL CORPORATION LIMITED, Maharashtra (IN)

(72) Inventors: Chinmay Abhijit Chaudhari, Faridabad (IN); Sachin Chugh, Faridabad (IN); Mohanraju Karuppannan, Faridabad (IN); Meenakshi Sundarraman, Faridabad (IN); Kapil Sonkar, Faridabad (IN); Alok Sharma, Faridabad (IN); Gurpreet Singh Kapur, Faridabad (IN); Sankara Sri Venkata Ramakumar, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 17/994,108

(22) Filed: Nov. 25, 2022

(65) Prior Publication Data

US 2023/0159838 A1 May 25, 2023

(30) Foreign Application Priority Data

Nov. 24, 2021 (IN) ..... 202121054253

(51) Int. Cl.
*C10L 3/10* (2006.01)
*C25B 1/02* (2006.01)
(Continued)

(52) U.S. Cl.
CPC *C10L 3/10* (2013.01); *C25B 1/02* (2013.01); *C25B 9/19* (2021.01); *C25B 9/67* (2021.01); *C25B 11/046* (2021.01); *C25B 13/05* (2021.01); *C25B 15/021* (2021.01); *C10L 2200/0277* (2013.01); *C10L 2290/06* (2013.01); *C10L 2290/38* (2013.01); *C10L 2290/58* (2013.01)

(58) Field of Classification Search
CPC ..... C10L 2200/0277; C10L 2290/06; C10L 2290/141; C10L 2290/38; C10L 2290/58; C10L 3/08; C10L 3/10; C25B 1/02; C25B 1/04; C25B 11/046; C25B 13/05; C25B 15/02; C25B 15/021; C25B 9/19; C25B 9/67; H01M 6/30; H01M 6/50
See application file for complete search history.

(56) References Cited

U.S. PATENT DOCUMENTS 5,513,600 A 5/1996 Teves
7,482,078 B2 1/2009 Sridhar et al.
(Continued)

FOREIGN PATENT DOCUMENTS

CA 2467443 A1 6/2003
WO 2019/112480 A1 6/2019
WO 2020/141368 A1 7/2020

*Primary Examiner* — Ellen M McAvoy
*Assistant Examiner* — Chantel Graham
(74) *Attorney, Agent, or Firm* — Maschoff Brennan

(57) ABSTRACT

The present invention discloses a single stage energy efficient process for production of hydrogen enriched/mixed gas at low temperature. More particularly, the present invention discloses a single stage energy efficient process for production of hydrogen enriched compressed natural gas (CNG) or LPG or biogas at low temperature.

20 Claims, 4 Drawing Sheets

(51) Int. Cl.

| | |
|---|---|
| ***C25B 9/19*** | (2021.01) |
| ***C25B 9/67*** | (2021.01) |
| ***C25B 13/05*** | (2021.01) |
| ***C25B 11/046*** | (2021.01) |
| ***C25B 15/021*** | (2021.01) |

(56) References Cited

U.S. PATENT DOCUMENTS

| | | | | |
|---|---|---|---|---|
| 9,315,910 | B2 | 4/2016 | Eastman et al. | |
| 9,574,276 | B2 | 2/2017 | Weibner et al. | |
| 9,840,446 | B2 | 12/2017 | Abbott | |
| 2011/0314814 | A1* | 12/2011 | Tsutsumi | C01B 3/14 422/198 |
| 2012/0304539 | A1* | 12/2012 | Badhe | C01B 3/38 48/128 |
| 2013/0323162 | A1* | 12/2013 | De Groot | C01B 3/16 422/162 |
| 2016/0376718 | A1 | 12/2016 | D'Elia et al. | |

* cited by examiner

SINGLE STAGE PROCESS FOR PRODUCTION OF HYDROGEN ENRICHED GAS

A single stage process for production of hydrogen enriched gas

FIELD OF THE INVENTION:

The present invention discloses a single stage energy efficient process for production of hydrogen enriched/mixed gas at low temperature. More particularly, the present invention discloses a single stage energy efficient process for production of hydrogen enriched compressed natural gas (CNG) or LPG or biogas at low temperature.

BACKGROUND OF THE INVENTION:

Hydrogen blending in existing natural gas distribution for various applications like transportation, domestic cooking and power generation is being examined as an interim way of decarbonising the energy sector. The hydrogen enriched mixture has certain advantages like reduced greenhouse gas (GHG) emissions, improved combustion characteristics, reduced knocking/detonation tendency in internal combustion (IC) engines and better fuel economy etc.

Many methods have been proposed for producing hydrogen enriched natural gas (NG) mixture or mixture of hydrogen with other gases which include partial reforming of methane or NG, high temperature co-electrolysis of $CO_2$ and steam to form methane, water electrolysis and high-pressure mixing arrangement for hydrogen and methane. The existing technologies or methods either operate at higher temperature (300° C. and above) and are not flexible to fuel flow rate variations with greater start up and shut down time.

All of the prior-art processes are either cost/energy intensive, need additional infrastructure and utilities, and result in significant energy loss, thereby making the blending process very complex. Some of methods are mentioned in following documents:

U.S. 2016/0376718 A1 discloses a method for upgrading a hydrocarbon using active hydrogen, by feeding hydrocarbon and source of hydrogen in two compartments divided by palladium membrane. Hydrogen is generated by pulsing the current in the compartment containing source of hydrogen. However, the source of hydrogen is considered as alkaline solution, the membrane is Pd-based with Pd-black catalyst and also the hydrocarbons considered for enrichment are thiophene,4,6-DMDBTP, QUI and combination of thereof.

WO 2019/112480 A1 relates to an apparatus and method for producing hydrogen, a hydrogen-methane mixture or a reaction gas containing H2 for the production of alcohols, ammonia, dimethyl ether and ethylene and for Fischer-Tropsch processes. However, the method is high temperature chemical conversion with source of hydrogen being methane. The method is neither electrochemical and nor the source of hydrogen is water.

U.S. Pat. No. 7,482,078 B2 demonstrates high temperature Solid oxide Regenerative fuel cell (SORFC) with Steam and CO2 electrolysis to form methane. However, low temperature/Proton conductive electrolyte and controlled hydrogen content in methane stream is not considered.

WO 2020/141368 A1 relates to method for hydrogen enrichment of a light hydrocarbon, in particular natural gas. The patent describes partial reforming of methane, with heating aided by solar concentrator. However, electrochemical route through water or other source, for hydrogen generation has not been considered.

U.S. Pat. No. 9,840,446 B2 describes process for production of methane-containing gas mixture. The process related to the high temperature methanation of carbon dioxide, steam and hydrogen over methanation catalyst. The discussed route is chemical conversion of reactants to methane.

U.S. Pat. No. 5,513,600A relates to water fuel converter for automotive and other engines. The process describes hydrogen generation using water electrolysis and subsequent utilization in either fuel lines or combustion chamber of IC engine. However, there is no consideration of any carrier gas or fuel gas for mixing with the generated hydrogen and the application is pertaining to direct application in IC engines only. Also the oxygen generated in the process is not considered for utilization in IC chamber to reduce emission and improved fuel economy.

CA2467443C discloses a method of producing hydrogen comprising: reacting water and a water-soluble oxygenated hydrocarbon having at least two carbon atoms, without photolysis, at a temperature not greater than 400° C., at a pressure where the water and the oxygenated hydrocarbon remain condensed liquids, and in the presence of a metal-containing catalyst, wherein the catalyst comprises a metal, such metal being a Group VIII transition metal, alloy thereof, or a mixture thereof.

U.S. Pat. No. 9,574,276B2 relates to a process for electrochemical hydrogen production is provided. The process includes providing an electrochemical cell with an anode side including an anode, a cathode side including a cathode, and a membrane separating the anode side from the cathode side. The process further includes feeding molecules of at least one gaseous reactant to the anode, oxidizing one or more molecules of the gaseous reactant at the anode to produce a gas product and protons, passing the protons through the membrane to the cathode, and reducing the protons at the cathode to form hydrogen gas.

U.S. Pat. No. 9,315,910B2 relates to a devices and methods for the production of hydrocarbons from carbon and hydrogen sources, such as, the production of alcohols from gaseous, carbonaceous influents in the presence of water.

Generation of pure hydrogen and subsequent blending with compressed natural gas (CNG) needs a separate compression-storage-mixing arrangement (with at least two mass flow controllers to address the changes in throughput of CNG or H2), thus making the process cost/energy intensive and making the blending very complex having higher response time.

The present invention describes the method to overcome the demerits associated with the above techniques, by presenting a single stage process for hydrogen production and its mixing with natural gas or any other gas, with quick start up and shut down time, low temperature operation and without any $CO_2$ footprint. The process of the present invention also presents flexibility in handling wider turn down ratios with additional advantage of generation of pure oxygen which can be utilized for relevant applications. The present invention can also be deployed for transportation of HCNG through gas trunk line for city gas distribution. The present invention also presents an ingenious solution to elude catalyst poisoning especially due to CO, present in the feed gas.

OBJECTIVES OF THE INVENTION:

It is a primary objective of the invention to provide a single stage process for hydrogen enriched compressed natural gas (CNG) or LPG or biogas production.

A further objective of the present invention is to eliminate the necessity of additional mixing device for hydrogen and gaseous fuel thus making the system more energy efficient and responsive.

Another objective of the present invention is to carry-out the process at low temperature and offers wide range of turn down ratio.

Yet another objective of the present invention is to presents flexibility in in level of hydrogen concentration in CNG.

Yet one another objective of the present invention is to generate pure oxygen which can be used for other applications.

SUMMARY OF THE INVENTION:

The present invention discloses a single stage process for generation of hydrogen enriched gas, wherein the process comprising: a) routing hydrogen source through heat exchanger HEX 08 to Zone-A of hydrogen enriched gas generation unit 04; b) maintaining localized hydrogen pressure at catalyst-PCPS (perforated catalyst protective sheets) interface higher than pressure prevailing PCPS-microchannel interface; c) passing feed gas for hydrogen enrichment through heat exchanger HEX 03 to Zone-B of hydrogen enriched gas generation unit 04.

In a feature of the present invention, the hydrogen enriched gas generated in step c) is passed through moisture eliminator 14 to buffer vessel 15 which is further compressed in hydrogen enriched gas compression unit 05 and stored in storage unit 06.

In a feature of the present invention, the hydrogen enriched gas generation unit 04 consists of a single unit or a combination of multiple units.

In a feature of the present invention, the process in the hydrogen enriched gas generation unit 04 is operated at a pressure in the range of 1-20 barg and at a temperature in the range of 25-80° C.

In a feature of the present invention, in step b) the localized hydrogen pressure at catalyst-PCPS interface higher than pressure prevailing PCPS-microchannel interface is maintained by applying DC Power Source 13.

In a feature of the present invention, the feed gas is selected from the group consisting of CNG, LPG and biogas with or without CO impurity.

In a feature of the present invention, the hydrogen enriched gas generation unit 04 is with ion conducting electrolyte and electrodes; and the electrodes are selected from the group consisting of noble metals, transition metals and any combinations thereof.

In a feature of the present invention, the noble metals are selected from the group comprising of Pt, Pd, Ru, Rh, Ir, Au, and Ag; and the transition metals are selected from the group comprising of Mo, Cu, Ni, Mg, Co, Cr, Sn, and W.

In a feature of the present invention, the ion conductive electrolyte is a solid or liquid electrolyte.

In a feature of the present invention, the catalyst-PCPS interface is with catalyst protective sheet between catalyst layer and flow channels in Zone-B to elude CO contamination.

In a feature of the present invention, the catalyst protective sheet is having high electrical conductivity, corrosion resistance, and optimized size and positions of perforations.

In a feature of the present invention, the catalyst protective sheet is made of carbon allotropes, Al, Cu, Au, Ag, Fe, Cr, or any combinations thereof; and the carbon allotrope is selected from graphite, graphene and CNT (carbon nanotubes).

In a feature of the present invention, catalyst surface of the Zone-B is prevented from poisoning with feed gas stream due to the maintained difference in the localized hydrogen pressure.

In a feature of the present invention, the hydrogen enriched gas generation unit 04 is with feedback or feed forward control mechanism to ensure desired hydrogen enrichment in CNG.

In a feature of the present invention, the hydrogen enriched gas generation unit 04 operates on voltage source not limited to any DC power source or energy converter for mobility and stationary applications.

In a feature of the present invention, the process generates a source of pure oxygen, and the process utilizes the pure oxygen generated during operation for making an oxygenated gas stream in downstream of Zone-B with or without hydrogen.

In a feature of the present invention, the process is having arrangement to control temperature of the hydrogen enriched gas generation unit 04 for hydrogen enriched gas generation.

In a feature of the present invention, the hydrogen enriched gas generation unit 04 is for in-situ measuring of hydrogen percentage in hydrogen mixed gas.

DETAILED DESCRIPTION OF THE INVENTION

Figure 1:
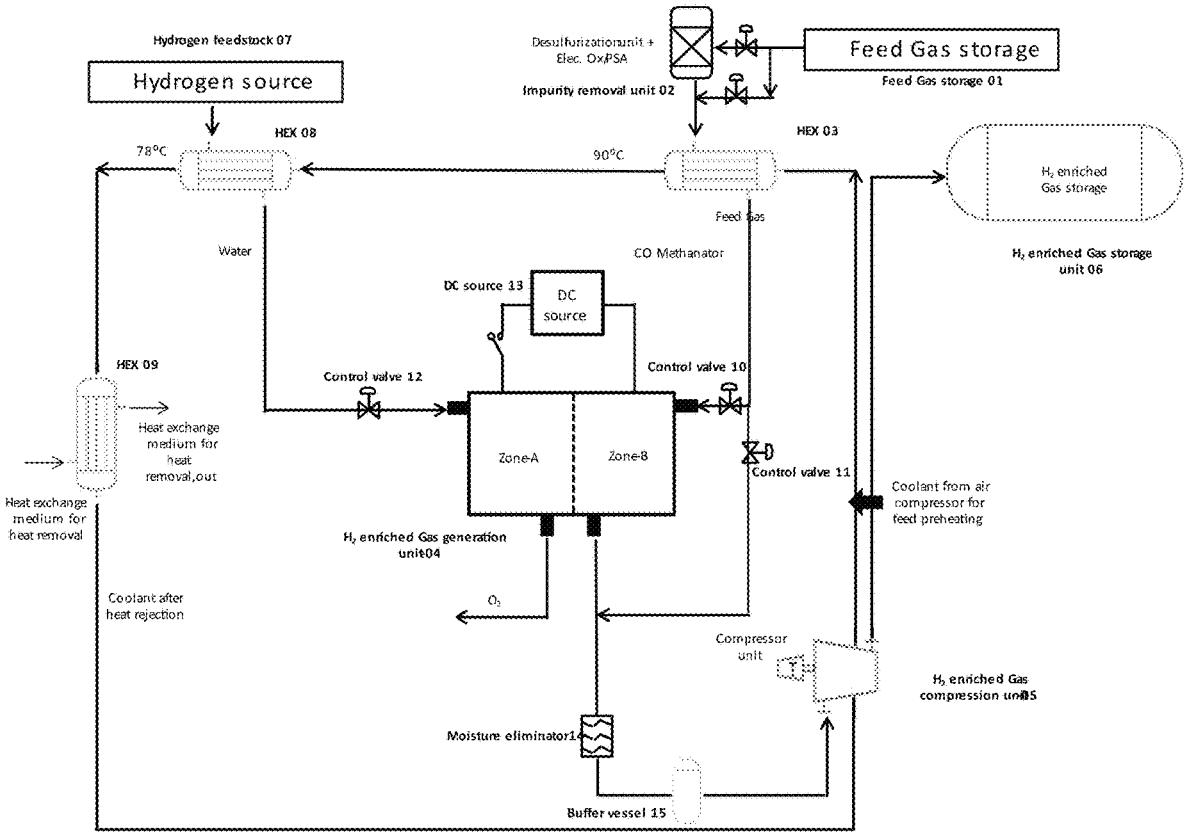
FIG. 1: illustrates the schematic representation of the method for the production of hydrogen enriched gas.
Figure 2:
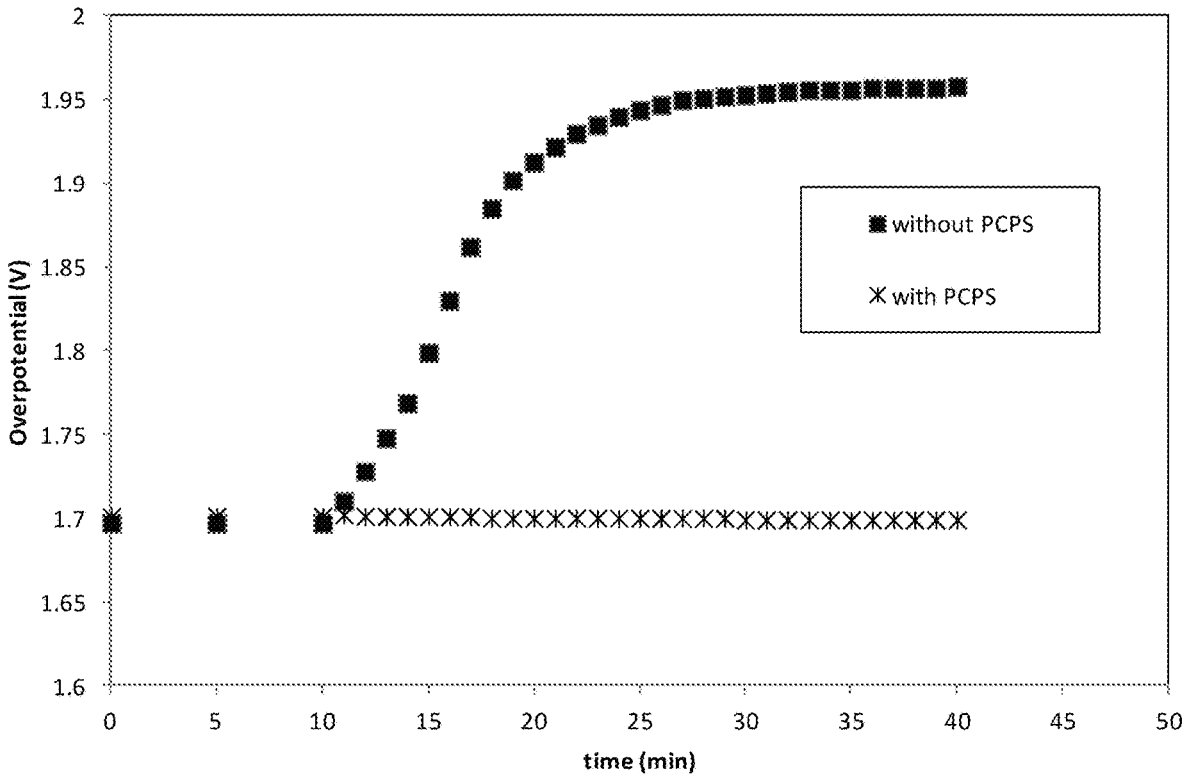
FIG. 2: illustrates the schematic representation of hydrogen enriched gas (HCNG) production with or without perforated catalyst protective sheet.
Figure 3:
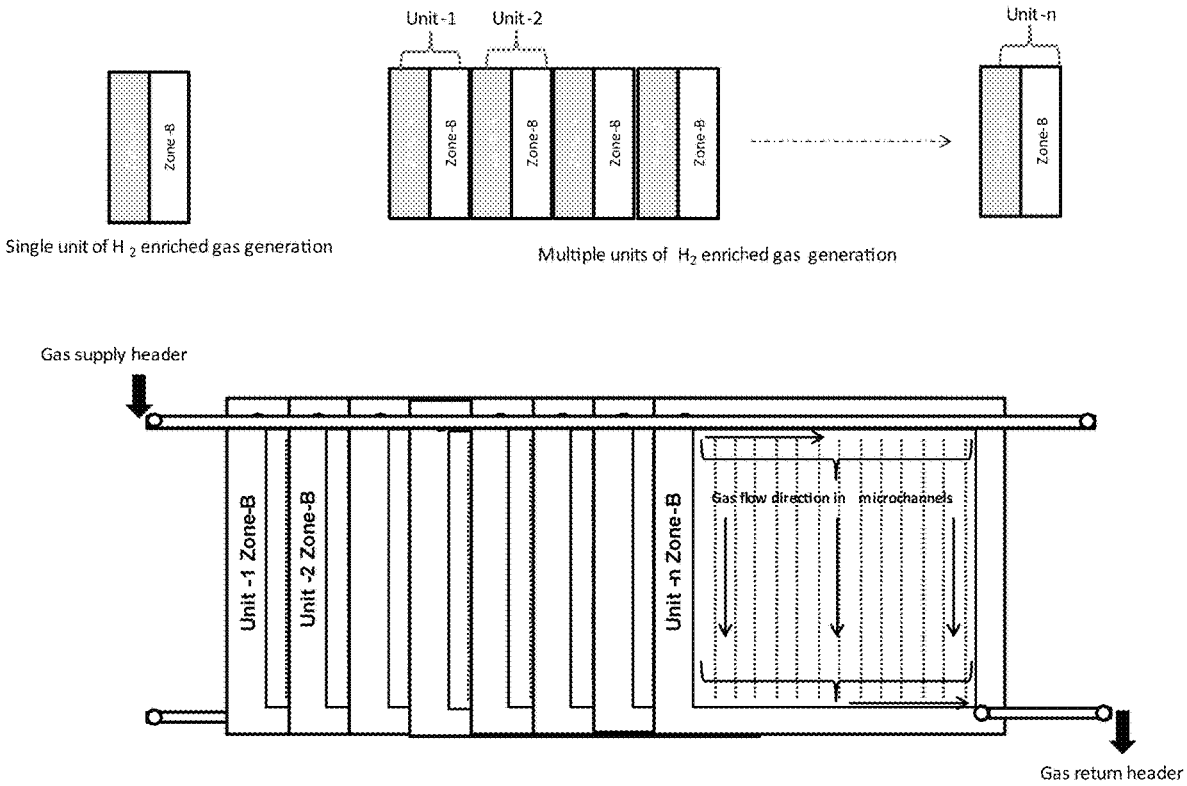
FIG. 3: illustrates the schematic representation of the configurations of multiple microchannels in hydrogen enriched gas production.
Figure 4:
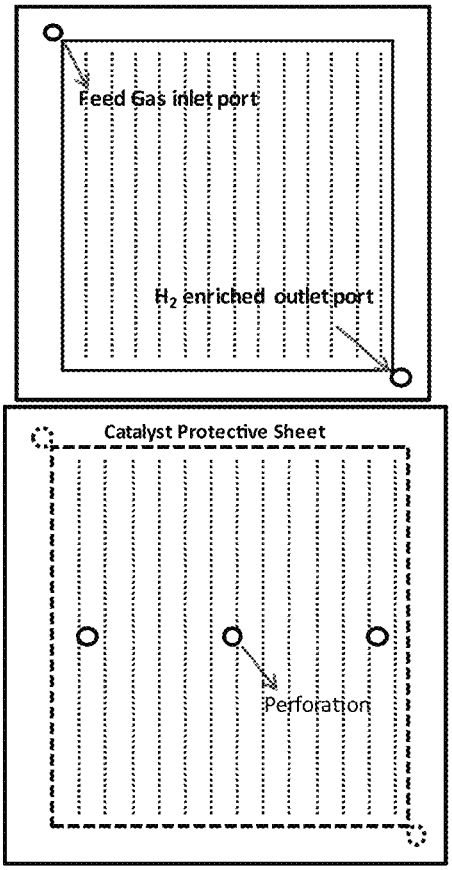
FIG. 4: illustrates the schematic representation of the catalyst protective sheets with possible perforation alternatives.

The present invention describes a HyRICH (hydrogen enrichment) process for HCNG (hydrogen mixed/enriched compressed natural gas) production. The process also presents quick start up and shut down solution and also eliminates the need of high temperature operation as evident in reported prior art (partial reforming, methanation or solid oxide electrolyzer cell (SOEC) based co-electrolysis). The process also presents flexibility not only in handling wider turn down ratios but also in level of hydrogen concentration in CNG, by optimizing the operating potential besides offering flexibility regarding the source of hydrogen (like water, methanol, ethanol etc.) by varying the operating conditions. In one typical mode of operation (with water as hydrogen feedstock), this technique also generates pure oxygen which can be utilized for various other applications. With the current configuration, the need of separate low/high pressure gas mixing arrangement (as in the case of separate hydrogen generation, compression, storage and mixing with CNG) is eliminated thus making the process more compact and energy efficient.

The present invention gives a single stage process for HCNG production. It eliminates the necessity of additional mixing device for hydrogen and gaseous fuel thus making the system more energy efficient and responsive. The process is carried out at low temperature and offers wide range of turn down ratio. The process also presents flexibility not only in handling wider turn down ratios but also in level of hydrogen concentration in CNG. The solution in the present process also generates pure oxygen, which can be used for other applications.

Carbon monoxide (CO) is a known impurity present in natural gas (NG) which poisons the catalyst of electrochemical device, resulting in higher energy losses to maintain same hydrogen concentration in product gas throughput. The present invention addressed the above issue in an efficient way by modifying the gas distribution material and flow design in HCNG generation unit.

The process of producing hydrogen enriched compressed natural gas (HCNG) consists of storage arrangement for base gas (CNG) (01) and hydrogen source (02) as shown in FIG. (1). CNG may contain contaminant such as sulfur and CO, which needs to be removed through suitable purification processes like desulfurization and CO-methanation/PSA/electrochemical oxidation respectively (02).

The adsorbents normally used in adsorption desulfurization processes are natural or synthetic zeolites, activated carbons, and metal oxides. These materials can have crystalline (zeolites) and/or amorphous structures (activated carbons) at both the macro and nanoscale, but they can be further modified to alter their physicochemical properties, thereby upgrading their adsorption capacity toward target molecule.

Presently, the Cu(i)-based adsorbents (zeolites or activated carbon) are mainly used for CO adsorption using PSA (pressure swing adsorption). Whereas $Ni/ZrO_2$ and $Ru/TiO_2$ were the most effective catalysts for complete removal of CO through the methanation. The present process presents flexibility of HCNG generation with or without CO in the feed gas thus the CO pre-treatment unit may also be eliminated.

FIG. (1) discloses the schematic representation of device and method for generation of hydrogen enriched/mixed gases.

CNG is preheated to desired process operating temperature in heat exchanger (03) through compressor waste heat. The flow rate of preheated CNG can be controlled through control valves (10 and 11) to allow partial or complete bypass in HCNG generation unit (04) depending on degree of hydrogen enrichment in HCNG production.

Water is preheated to process operating temperature (70-80° C.) through heat exchanger (08) by utilizing the heat rejected by compressor coolant stream. However, the preheating stage for both gas feed and water is optional and can be omitted during system start-up. The flow rate of hydrogen feedstock to zone-A of HCNG generation unit (04) can be controlled through control valve (12).

The present invention process consists of HCNG generation unit (04) having two zones, one for hydrogen source (Zone-A) and other for HCNG generation reaction (Zone-B), in a single step. Hydrogen feedstock is oxidized at Zone-A, whereas hydrogen generation and homogeneous mixing with CNG occurs at Zone-B. Zone-B of HCNG generation unit consists of perforated catalyst protective sheets (PCPS) which prevents catalyst poisoning issue from impurities present in the feed (especially CO). PCPS is highly electrically conductive and designed with optimized number of opening for hydrogen diffusion. HCNG generation without PCPS results in higher energy losses due to CO poisoning of catalyst as shown in FIG. (2). Hydrogen generation unit (HCNG) may consist of single unit or combinations of multiple units. In FIG. (3), each individual unit is connected in common header where CNG gas stream is distributed among all units of Zone-B equally. Each Zone-B is also consisting of optimized micro channels configurations to ensure uniform mixing and homogeneous gas compositions of HCNG. The structure enables the efficient arrangement of numerous channels and allows uniform gas distribution and mixing in each of channels. During start-up phase, localized hydrogen pressure at catalyst-PCPS interface is maintained higher than pressure prevailing PCPS-microchannel interface by applying DC Power Source 13. Until then control valve-10 is maintained in OFF position to avoid catalyst contamination by any gas impurity. CNG or any other gas for hydrogen enrichment is then passed through heat exchanger (HEX 03) to control valve-10 into zone-B of HCNG generation unit 04. Control valve 10 is maintained in ON position during subsequent operation. CNG gas stream is prevented from poisoning catalyst surface of Zone-B due to the maintained pressure difference. Hydrogen enriched gas is then passed through moisture eliminator 14 to buffer vessel 15 which is further compressed in compression unit 05 and stored in storage unit 06. Operating pressure of HCNG generation unit (04) is maintained at 1-20 barg and temperature (25-80° C.). The two zones are separated by ion conductive polymer with suitable catalyst (such as Pt, Au, Ir etc.) to enhance the rate of hydrogen generation reaction. Since the feed gas is preheated to operating temperature of 70-80° C., molecular collision between Hydrogen and CNG is greatly enhanced in the microchannels. Turbulent mixing of HCNG is further enhanced due to recombination of multiple gas streams from various microchannels of several units mixing together in the return header. FIG. (4) depicts one such design for PCPS. The perforation position and size is determined by availability of mixing length, localized pressure distribution of gas stream in microchannel and degree of mixing in microchannel configuration. The high heat transfer coefficient in the channels ensures instantaneous heat absorption/rejection from heat transfer media due to excess enthalpy of hydrogen-NG mixing. Effective % RH (Relative Humidity) of HCNG stream at the outlet of HCNG generation unit (08) is lower than the conventional saturated Hydrogen stream in PEM (Proton exchange membrane) water electrolyser. Thus, better water management enhances operation efficiency.

The process is a single stage process which means the desired concentration of $H_2$ can be achieved in a single step without any further need of thermal/electrochemical conversion. There are no different stages of process. The process is continuous and desired product is delivered at the end of first step itself.

Localized hydrogen pressure at catalyst sites is greater than partial pressure of gas on the other side of PCPS, thereafter, a positive flux of hydrogen is maintained from catalyst sites into microchannels. PCPS acts a diaphragm in between catalyst and microchannels. The perforations in PCPS allows hydrogen molecules to pass through them freely.

The reaction in Zone-A is can be summarized as below:

For Water based feed:

$$H_2O \rightleftharpoons 2H^+ + \frac{1}{2}O_2 + 2e^* \quad (1)$$

Whereas the reaction in Zone-B is as given below:

$$2H^+ + 2e^- + CH_4 \leftrightarrows H_2 + CH_4 \quad (2)$$

The rate of hydrogen enrichment can be controlled by the applied potential across two zones through DC source (13), thereby giving the user flexibility of deciding the degree of hydrogen enrichment in CNG, without changing any other process parameter, through feed forward mechanism.

The HCNG generation unit (04) can operate intermittently or continuously to generate HCNG depending on downstream requirement. The process also offers flexibility of changing the fuel (like LPG and biogas) to be enriched, without any need of changing the device or catalyst.

The resultant HCNG generated from Zone-B is stored in buffer tank (15) which is compressed in compression unit (05) to the suitable pressure. HCNG is then stored in storage vessel (06) before being dispensed/transported for further application. The compressor unit can be deployed with suitable coolant for interstage cooling to maintain near ambient discharge temperature of the compressed stream. Heat integration of the coolant stream can be done with CNG and water feed to HyRICH for better system efficiency. During the operation, pure oxygen is also generated from Zone-A (for the case of water-based operation mode) which can be further utilized for other application.

The complete operation can be regulated by pre-defined logic-based controller so as to ensure same level of hydrogen enrichment for variable fuel flow rate or variable hydrogen enrichment of fuel with same flow rate or combination of thereof.

The generated oxygen can be utilized for various medical or industrial applications. For on-board deployment of HyRICH for automotive applications, generated oxygen can be utilized for making oxygenated gas stream to improve fuel economy. The HyRICH system pressure can be adjusted to make it suitable for integration with gas trunkline, for distribution of hydrogen enriched fuel.

In an aspect of the present invention, the presentation invention discloses a single stage process for generation of hydrogen enriched gas, wherein the process comprising: a) routing hydrogen source through heat exchanger HEX 08 to Zone-A of hydrogen enriched gas generation unit 04; b) maintaining localized hydrogen pressure at catalyst-PCPS (perforated catalyst protective sheets) interface higher than pressure prevailing PCPS-microchannel interface; c) passing feed gas for hydrogen enrichment through heat exchanger HEX 03 to Zone-B of hydrogen enriched gas generation unit 04.

In an aspect of the present invention, the presentation invention discloses a single stage process for generation of hydrogen enriched gas, wherein the process comprising: a) routing hydrogen source through heat exchanger HEX 08 to Zone-A of hydrogen enriched gas generation unit 04; b) maintaining localized hydrogen pressure at catalyst-PCPS (perforated catalyst protective sheets) interface higher than pressure prevailing PCPS-microchannel interface by applying DC Power Source 13 and maintaining Control valve-10 in OFF position to avoid catalyst contamination by any gas impurity; c) passing feed gas for hydrogen enrichment through heat exchanger HEX 03 to the control valve-10 into Zone-B of hydrogen enriched gas generation unit 04 and maintaining the control valve 10 in ON position during subsequent operation; d) preventing poisoning of catalyst surface of Zone-B with feed gas stream due to the maintained difference in the localized hydrogen pressure; e) passing the hydrogen enriched CNG generated in step c) through moisture eliminator 14 to buffer vessel 15 which is further compressed in hydrogen enriched gas compression unit 05 and stored in storage unit 06.

In an aspect of the present invention, the presentation invention discloses a single stage process for generation of hydrogen enriched compressed natural gas (HCNG), wherein the process comprising: a) routing hydrogen source through heat exchanger HEX 08 to Zone-A of HCNG generation unit 04; b) maintaining localized hydrogen pressure at catalyst-PCPS (perforated catalyst protective sheets) interface higher than pressure prevailing PCPS-microchannel interface by applying DC Power Source 13 and maintaining Control valve-10 in OFF position to avoid catalyst contamination by any gas impurity; c) passing CNG or any other gas for hydrogen enrichment through heat exchanger HEX 03 to the control valve-10 into Zone-B of HCNG generation unit 04 and maintaining the control valve 10 in ON position during subsequent operation; d) preventing poisoning of catalyst surface of Zone-B with CNG gas stream due to the maintained difference in the localized hydrogen pressure; e) passing the hydrogen enriched CNG or any other gas through moisture eliminator 14 to buffer vessel 15 which is further compressed in HCNG compression unit 05 and stored in storage unit 06.

In an embodiment of the present invention, the ion conductive polymer is tetrafluoroethylene-perfluoro-3,6-dioxa-4-methyl-7-octenesulfonic acid copolymer.

In one another aspect of the present invention, the present invention discloses a single stage process for generation of hydrogen enriched gas, wherein the process comprising: a) routing hydrogen source through heat exchanger HEX 08 to Zone-A of hydrogen enriched gas generation unit 04; b) maintaining localized hydrogen pressure at catalyst-PCPS (perforated catalyst protective sheets) interface higher than pressure prevailing PCPS-microchannel interface; c) passing feed gas for hydrogen enrichment through heat exchanger HEX 03 to Zone-B of hydrogen enriched gas generation unit 04.

In an embodiment of the present invention, the hydrogen enriched gas generated in step c) is passed through moisture eliminator 14 to buffer vessel 15 which is further compressed in hydrogen enriched gas compression unit 05 and stored in storage unit 06.

In an embodiment of the present invention, the hydrogen enriched gas generation unit 04 consists of a single unit or a combination of multiple units.

In an embodiment of the present invention, the process in the hydrogen enriched gas generation unit 04 is operated at a pressure in the range of 1-20 barg and at a temperature in the range of 25-80° C.

In an embodiment of the present invention, in step b) the localized hydrogen pressure at catalyst-PCPS interface higher than pressure prevailing PCPS-microchannel interface is maintained by applying DC Power Source 13.

In an embodiment of the present invention, the feed gas is selected from the group consisting of CNG, LPG and biogas with or without CO impurity.

In an embodiment of the present invention, the hydrogen enriched gas generation unit 04 is with ion conducting electrolyte and electrodes; and the electrodes are selected from the group consisting of noble metals, transition metals and any combinations thereof.

In an embodiment of the present invention, the noble metals are selected from the group comprising of Pt, Pd, Ru, Rh, Ir, Au, and Ag; and the transition metals are selected from the group comprising of Mo, Cu, Ni, Mg, Co, Cr, Sn, and W.

In an embodiment of the present invention, the ion conductive electrolyte is a solid or liquid electrolyte.

In an embodiment of the present invention, the catalyst-PCPS interface is with catalyst protective sheet between catalyst layer and flow channels in Zone-B to elude CO contamination.

In an embodiment of the present invention, the catalyst protective sheet is having high electrical conductivity, corrosion resistance, and optimized size and positions of perforations.

In an embodiment of the present invention, the catalyst protective sheet is made of carbon allotropes, Al, Cu, Au, Ag, Fe, Cr, or any combinations thereof and the carbon allotrope is selected from graphite, graphene and CNT (carbon nanotubes).

In an embodiment of the present invention, catalyst surface of the Zone-B is prevented from poisoning with feed gas stream due to the maintained difference in the localized hydrogen pressure.

In an embodiment of the present invention, the hydrogen enriched gas generation unit 04 is with feedback or feed forward control mechanism to ensure desired hydrogen enrichment in CNG.

In an embodiment of the present invention, the hydrogen enriched gas generation unit 04 operates on voltage source not limited to any DC power source or energy converter for mobility and stationary applications.

In an embodiment of the present invention, the process generates a source of pure oxygen, and the process utilizes the pure oxygen generated during operation for making an oxygenated gas stream in downstream of Zone-B with or without hydrogen.

In an embodiment of the present invention, the process is having arrangement to control temperature of the hydrogen enriched gas generation unit 04 for hydrogen enriched gas generation.

In an embodiment of the present invention, the hydrogen enriched gas generation unit 04 is for in-situ measuring of hydrogen percentage in hydrogen mixed gas.

In an embodiment of the present invention, the noble metals are selected from the group consisting of Pt, Pd, Ru, Rh, Ir, Au, and Ag; and the transition metals are selected from the group consisting of Mo, Cu, Ni, Mg, Co, Cr, Sn, and W.

The technical advantages offered by the present invention are:

Single stage process (HyRICH process) for HCNG or hydrogen enriched (0.1-99.9%) gas production;

High tolerance to presence of impurity in natural gas or in any gas stream (mainly CO);

Zero carbon footprint process;

Energy efficient process as operated at low temperature;

Fast start-up and shut down as required;

Wide turn-down ratio (practically from 0 to 1 in lowest time);

Elimination of need of a separate high pressure gas mixing arrangement;

Flexibility of selection of gaseous fuel for Hydrogen enrichment;

Co-generation of pure oxygen gas;

Improved fuel economy with oxygen supported combustion (vs conventional air combustion) in end application when used on board;

Single step in-situ enrichment process; and

Integration can be done with gas trunk line for city gas distribution of hydrogen blended gaseous fuels.

EXAMPLES

Example 1:

FIG. (2) graphically illustrates hydrogen enrichment of NG. The graph shows performance comparison of HCNG generation unit with and without unit PCPS. The PCPS is made of copper with optimized number of holes. The ion conducting membrane between zone-A and zone-B is Nafion™-117 (Tetrafluoroethylene-perfluoro-3,6-dioxa-4-methyl-7-octenesulfonic acid copolymer). The membrane is coated with $IrO_2$ (2 mg/cm$^2$) and 40% Pt/C (0.2 mg/cm$^2$) as zone-A and zone-B catalysts respectively with active area of 25 cm$^2$. Water is used as the source of hydrogen. Flow rates of water and gas were maintained at 0.05 LPM and 0.32 NLPM respectively. The operating temperature and pressure of HCNG generation unit were 50° C. and 1.5 barg respectively. Hydrogen enrichment level in final mixture was maintained at 18% (v/v). FIG. (2) reveals that PCPS prevents catalyst contamination (due to CO) by maintaining same overpotential throughout the operation as against HCNG generation without PCPS which records increase in overpotential requirement.

The invention claimed is:

1. A single stage process for generation of hydrogen enriched gas, the process comprising:

a) providing an ion conducting membrane between Zone-A and Zone-B of a hydrogen enriched gas generation unit;

b) routing a hydrogen source through a heat exchanger HEX 08 to Zone-A of the hydrogen enriched gas generation unit, wherein Zone-A is configured to oxidize the hydrogen source to generate hydrogen ions, and wherein the hydrogen ions generated pass through the ion conducting membrane to a catalyst layer of Zone-B;

c) maintaining a higher localized hydrogen pressure at an interface of catalyst and perforated catalyst protective sheets (PCPS) than a pressure prevailing at an interface of PCPS and microchannels in Zone-B; and d) passing a feed gas through a heat exchanger HEX 03 to Zone B wherein feed gas and hydrogen ions are homogeneously mixed in the microchannels of Zone-B for generating the hydrogen enriched feed gas, wherein the process is an electrochemical process.

2. The process as claimed in claim 1, wherein the hydrogen enriched gas generated is passed through a moisture eliminator to a buffer vessel, wherein after moisture elimination, the hydrogen enriched gas is further compressed in a hydrogen enriched gas compression unit and is stored in a storage unit.

3. The process as claimed in claim 1, wherein the hydrogen enriched gas generation unit comprises a single unit or a combination of multiple units.

4. The process as claimed in claim 1, wherein the hydrogen enriched gas generation unit is operated at a pressure in a range of 1-20 barg and at a temperature in a range of 25-80° C.

5. The process as claimed in claim 1, wherein the higher localized hydrogen pressure at the interface of the catalyst-PCPS than the prevailing pressure at the interface of the PCPS-microchannel is maintained by applying a DC power source.

6. The process as claimed in claim 1, wherein the feed gas is selected from the group consisting of CNG, LPG and biogas, and wherein the CNG, LPG and biogas are with or without CO impurity.

7. The process as claimed in claim 1, wherein the hydrogen enriched gas generation unit comprises an ion conducting electrolyte and electrodes; and wherein the electrodes are selected from the group consisting of noble metals, transition metals and a combination thereof.

8. The process as claimed in claim 7, wherein the noble metals are selected from the group consisting of Pt, Pd, Ru, Rh, Ir, Au, and Ag; and wherein the transition metals are selected from the group consisting of Mo, Cu, Ni, Mg, Co, Cr, Sn, and W.

9. The process as claimed in claim 7, wherein the ion conductive electrolyte is a solid or liquid electrolyte.

10. The process as claimed in claim 5, wherein the interface at the catalyst-PCPS comprises a catalyst protective sheet between a catalyst layer and flow channels in the Zone-B to elude CO contamination.

11. The process as claimed in claim 10, wherein the catalyst protective sheet has electrical conductivity, corrosion resistance, and optimized size and positions of perforations.

12. The process as claimed in claim 10, wherein the catalyst protective sheet is made of carbon allotropes, Al, Cu, Au, Ag, Fe, Cr, or a combination thereof, and wherein the carbon allotrope is selected from the group consisting of graphite, graphene, and carbon nanotubes (CNT).

13. The process as claimed in claim 1, wherein the Zone-B of the hydrogen enriched gas generation unit comprises a catalyst surface, wherein the catalyst surface is configured to prevent poisoning with the feed gas due to the maintained difference in the localized hydrogen pressure.

14. The process as claimed in claim 1, wherein the hydrogen enriched gas generation unit comprises a feedback or a feed forward control mechanism to ensure hydrogen enrichment in the feed gas.

15. The process as claimed in claim 1, wherein the hydrogen enriched gas generation unit operates on a voltage source, wherein the voltage source is a DC power source or an energy converter.

16. The process as claimed in claim 1, wherein the process generates pure oxygen, and wherein the pure oxygen is used for making an oxygenated gas stream with or without hydrogen in a downstream of the Zone-B.

17. The process as claimed in claim 1, wherein the hydrogen enriched gas generation unit comprises a temperature controller to control temperature for hydrogen enriched gas generation.

18. The process as claimed in claim 1, wherein the hydrogen enriched gas generation unit is configured for in-situ measuring of hydrogen percentage in a hydrogen mixed gas.

19. The process as claimed in claim 1, wherein the ion conducting membrane between Zone-A and Zone-B comprises Tetrafluoroethylene-perfluoro-3,6-dioxa-4-methyl-7-octenesulfonic acid copolymer.

20. The process as claimed in claim 19, wherein the ion conducting membrane is coated with $IrO_2$ in Zone-A and with 40% Pt/C in Zone-B with an active area of 25 $cm^2$.

* * * * *